US007177434B2

(12) United States Patent
Tripoli

(10) Patent No.: US 7,177,434 B2
(45) Date of Patent: Feb. 13, 2007

(54) STEPPED SOUND PRODUCING MODULE

(75) Inventor: Melchiore Tripoli, Pittsburgh, PA (US)

(73) Assignee: Sing-A-Tune Balloons, LLC, Boca Raton, FL (US)

( * ) Notice: Subject to any disclaimer, the term of this patent is extended or adjusted under 35 U.S.C. 154(b) by 839 days.

(21) Appl. No.: 10/053,096

(22) Filed: Jan. 18, 2002

(65) Prior Publication Data

US 2003/0138120 A1 Jul. 24, 2003

(51) Int. Cl.
*H04R 25/00* (2006.01)
*A63H 3/06* (2006.01)

(52) U.S. Cl. ..... 381/190; 381/191; 367/155; 446/220

(58) Field of Classification Search ..... 340/384.6; 381/190, 173, 191; 367/155
See application file for complete search history.

(56) References Cited

U.S. PATENT DOCUMENTS 3,478,343 A 11/1969 Wallace
3,649,789 A 3/1972 Stoll
3,740,543 A 6/1973 Franc
4,464,861 A 8/1984 Fogarty et al.
4,638,207 A 1/1987 Radice
4,641,054 A * 2/1987 Takahata et al. ..... 310/324
4,704,934 A 11/1987 Nosrati
4,737,981 A 4/1988 Hoberman et al.
4,817,138 A 3/1989 Thomke et al.
4,823,907 A * 4/1989 Hoshi ..... 181/173
4,920,674 A 5/1990 Shaeffer
4,922,527 A 5/1990 Nonami
5,054,778 A 10/1991 Maleyko
5,108,338 A * 4/1992 Margolis ..... 446/220
5,115,472 A 5/1992 Park
5,157,712 A 10/1992 Wallen, Jr.
5,215,492 A 6/1993 Kubiatowitz
5,254,007 A 10/1993 Eagan
5,309,519 A 5/1994 Park
5,403,222 A 4/1995 Koenig et al.
5,515,444 A * 5/1996 Burdisso et al. ..... 381/71.5
5,555,100 A 9/1996 Bloomfield et al.
5,559,611 A 9/1996 Bloomfield et al.
5,609,411 A 3/1997 Wang
5,648,129 A 7/1997 Lee et al.
5,669,702 A 9/1997 Wang (Continued)

OTHER PUBLICATIONS

Paradiso, J.A., The Interactive balloon: Sensing, actuation, and behavior in a common object, IBM Systems Journal, 1996, 473-487, vol. 35, No. 3&4, IBM, USA.

*Primary Examiner*—Xu Mei
(74) *Attorney, Agent, or Firm*—Mintz Levin Cohn Ferris Glovsky and Popeo PC

(57) ABSTRACT

A generally pyramid shaped sound module is provided that is attachable to a balloon for producing hi-fidelity sound effects. The sound module includes a piezoelectric element connected at the top of the pyramid shaped piezo amplification device. An electric circuit is connected to the piezoelectric element by wires. The electric circuit includes a power supply, such as one or more batteries, and the circuitry necessary for producing or reproducing a desired sound (e.g. musical notes, voices, sounds, prerecorded sound, a combination of the aforementioned, etc.). The pyramid shape allows the piezoelectric element to be coupled to the balloon without physically touching the balloon surface. Thus, even when the balloon begins to deflate, the sound quality of the sound module can be maintained.

19 Claims, 7 Drawing Sheets

U.S. PATENT DOCUMENTS 5,725,445 A 3/1998 Kennedy
5,782,668 A 7/1998 Chabert
5,893,798 A 4/1999 Stambolic et al.
5,936,521 A 8/1999 Blackman
6,012,826 A 1/2000 Chabert
6,238,067 B1 5/2001 Hirsch
6,482,065 B1 * 11/2002 Blackman ..... 446/220
D469,429 S 1/2003 Blackman
6,821,183 B2 11/2004 Blackman et al.

* cited by examiner

STEPPED SOUND PRODUCING MODULE

CROSS-REFERENCE TO RELATED APPLICATIONS

N/A

STATEMENT REGARDING FEDERALLY SPONSORED RESEARCH OR DEVELOPMENT

N/A

REFERENCE TO A SEQUENCE LISTING

N/A

BACKGROUND OF THE INVENTION

Electro-mechanical sound reproduction devices have been employed since the early days of cylindrical wax recordings. Simply stated, a membrane of some sort is used in a piston action to mechanically move air, creating sound waves audible to the listener. The electro-mechanical "speaker" is the result of many years of engineering, in which a paper or plastic cone is affixed to a coil of wire. The coil is supplied with an iron core, and surrounded by a magnet. This arrangement surrounds the wire in a magnetic field, forming an electro-magnet. When an alternating current (AC) signal is applied to the coil, the coil moves with a piston action (back and forth). This moves the attached cone, pushing air, creating sound. This arrangement results in high quality sound reproduction, but is very heavy and requires a large amount of power to achieve audible sound levels.

A different form of sound producer is available known as a "piezoelectric element". Piezoelectric elements are small, very lightweight, and require relatively low power to produce sound. The piezoelectric element includes a crystal that produces electricity when flexed, or flexes when an electrical current is applied. The crystal is mechanically bonded to a "carrier plate", typically a small, thin brass disk. By applying an alternating current to the piezoelectric element, sound can be produced.

Because of the nature of the piezoelectric element, however, it is only capable of producing certain narrow band frequencies efficiently. Typically, piezoelectric elements are used for producing single tones at a "resonant frequency" (the frequency at which they require the lowest amount of power to produce the highest sound level). Different piezoelectric elements have different resonant frequencies.

However, conventional piezoelectric sound producing modules suffer from a number of drawbacks. They do not provide hi-fidelity sound, the volume is generally very low, and the sound quality is very poor. Devices that do produce hi-fidelity sound are generally too heavy for attaching to a balloon and require too much power to drive the device.

Accordingly, it would be advantageous to produce a sound module, which employs piezoelectric elements. It would further be advantageous to produce such a sound module that is designed to: be attached to a balloon, provide hi-fidelity sound, provide higher volume, reproduce prerecorded sound, and maintain sound quality even as the balloon begins to deflate.

BRIEF SUMMARY OF THE INVENTION

The present invention provides a sound module attachable to an object. The sound module includes a piezo amplification device having a top and a bottom and an interior. A piezoelectric element is connected to the piezo amplification device substantially at the top of the piezo amplification device. The piezo amplification device is attachable to the object at the bottom of the piezo amplification device. When the piezo amplification device is attached to the inflatable object, the interior of the piezo amplification device and the inflatable object form a cavity.

Another aspect of the invention provides a sound module attachable to an object. The sound module includes a piezoelectric element and a piezo amplification device module for housing the piezoelectric element and for attaching the piezoelectric element to the inflatable object. The sound module also includes a circuit module electrically connected to the piezoelectric element for generating audio signals. The piezoelectric element is configured to convert the audio signals generated by the circuit module into sound that resonates within the object.

Still another aspect of the invention provides a method of producing sound that resonates within an object. The method includes housing a piezoelectric element at substantially the top of a piezo amplification device and electrically connecting a circuit designed to produce audio signals to the piezoelectric element. The method also includes connecting the piezo amplification device to the object in a way that forms a cavity between the piezo amplification device and the object.

Another aspect of the invention provides a sound module attachable to an inflatable object. The sound module includes a semi-rigid pyramid shaped piezo amplification device having a top, a bottom and an interior. The pyramid shape is formed by concentrically stacking rings such that a ring stacked closer to the top of the piezo amplification device is smaller than a ring stacked closer to the bottom of the piezo amplification device. The piezo amplification device is attachable to the inflatable object at a bottom most ring of the piezo amplification device such that when the piezo amplification device is attached to the inflatable object, a cavity is formed between the interior of the piezo amplification device and the inflatable object. A piezoelectric element is connected to one of the rings at the top of the piezo amplification device and an electrical circuit is electrically connected to the piezoelectric element. The electrical circuit is configured to generate audio signals, and the piezoelectric element is configured to convert the audio signals into sound that resonates within the inflatable object.

The invention will next be described in connection with certain illustrated embodiments; however, it should be clear to those skilled in the art that various modifications, additions and subtractions can be made without departing from the spirit or scope of the claims.

BRIEF DESCRIPTION OF THE SEVERAL VIEWS OF THE DRAWINGS

For a fuller understanding of the nature of the invention, reference should be made to the following detailed description and accompanying drawings, in which.

DETAILED DESCRIPTION OF THE INVENTION

Figure 1:
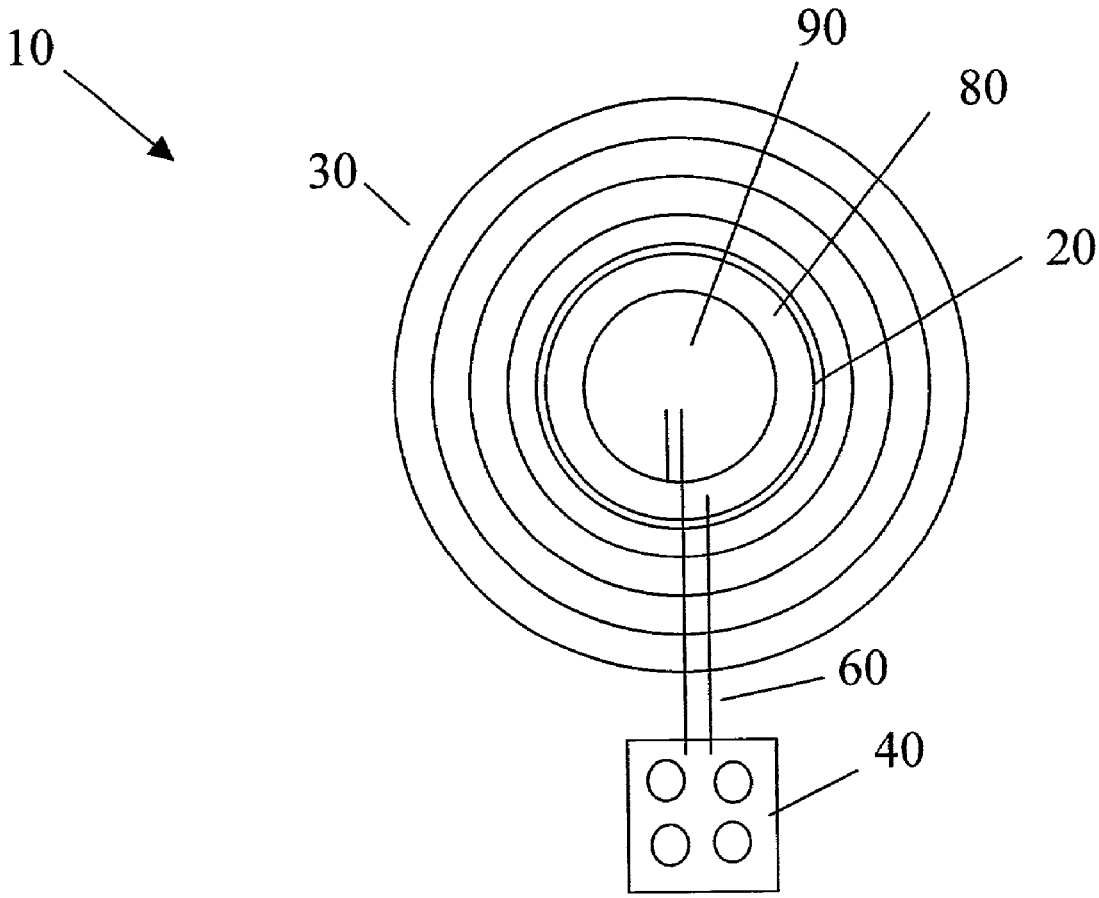
FIG. 1 is a front view of a sound module in accordance with an embodiment of the invention.

The invention provides a sound module for attaching to a balloon. As illustrated in FIG. 1, the sound module 10 includes a piezoelectric element 20 connected to a piezo amplification device 30. The sound module 10 also includes an electric circuit 40 connected to the piezoelectric element 20 by wires 60. The electric circuit 40 includes a power supply, such as one or more batteries, and the circuitry necessary for producing or reproducing a desired sound (e.g. musical notes, voices, sounds, prerecorded sound, a combination of the aforementioned, etc.). Since the circuitry for producing a desired sound is well known to those skilled in the art, no further description is necessary and the electric circuit 40 will not be described further herein.

The piezoelectric element 20 includes 2 crystals 90 connected to opposite sides of a carrier plate 80. Each of the crystals 90 are attached to the electric circuit 40. Those skilled in the art will recognize that piezoelectric element 20 could be designed with a single crystal 90 and still fall within the scope of the present invention.

The piezoelectric element 20 is most efficient at its resonant frequency. By changing the piezoelectric element 20, it can be made to be resonant at a different frequency. However, simply increasing the size of the piezoelectric element 20 may only be practical to a point, after which further increases in the size produces diminishing returns. In other words, as the mass of the carrier plate 80 increases, so does the amount of power needed to flex plate 80 and to produce higher sound levels. While for many applications the increased weight of the piezoelectric element 20 and of the power supply required to drive the piezoelectric element are not important, when the sound module 10 is to be attached to a helium filled balloon, if the weight is so heavy that it interferes with the buoyancy of the balloon, it may not be practical.

To overcome both the mechanical disadvantages of the increased mass and the increased power requirements, the piezoelectric element 20 is attached to a piezo amplification device 30. The piezo amplification device 30 is preferably constructed of lightweight expanded polystyrene foam, although other materials such as cardboard, paper, plastic, some other semi-rigid material or combinations thereof may be employed. It has been determined that by forming a series of interconnected concentric rings of increasing diameter, and stacking these rings one on another, operation of the piezoelectric element 20 is enhanced at frequencies other than only the resonant frequency. By varying the width of these rings, the frequencies that are reproduced can "overlap" and be controlled, achieving a flattening of the frequency response (looking at a frequency response graph, one would normally see nodes or peaks, but varying the width of the rings flattens these nodes). It has also been determined that the thickness of the foam contributes to the efficiency of the system, and controlling the volume of the sound produced. While not preferred, those skilled in the art will recognize that a cone shaped piezo amplification device 30 is equivalent to the stepped device 30 in that a cone may be considered to be an infinite number of concentrically stacked rings of varying size.

Figure 2:
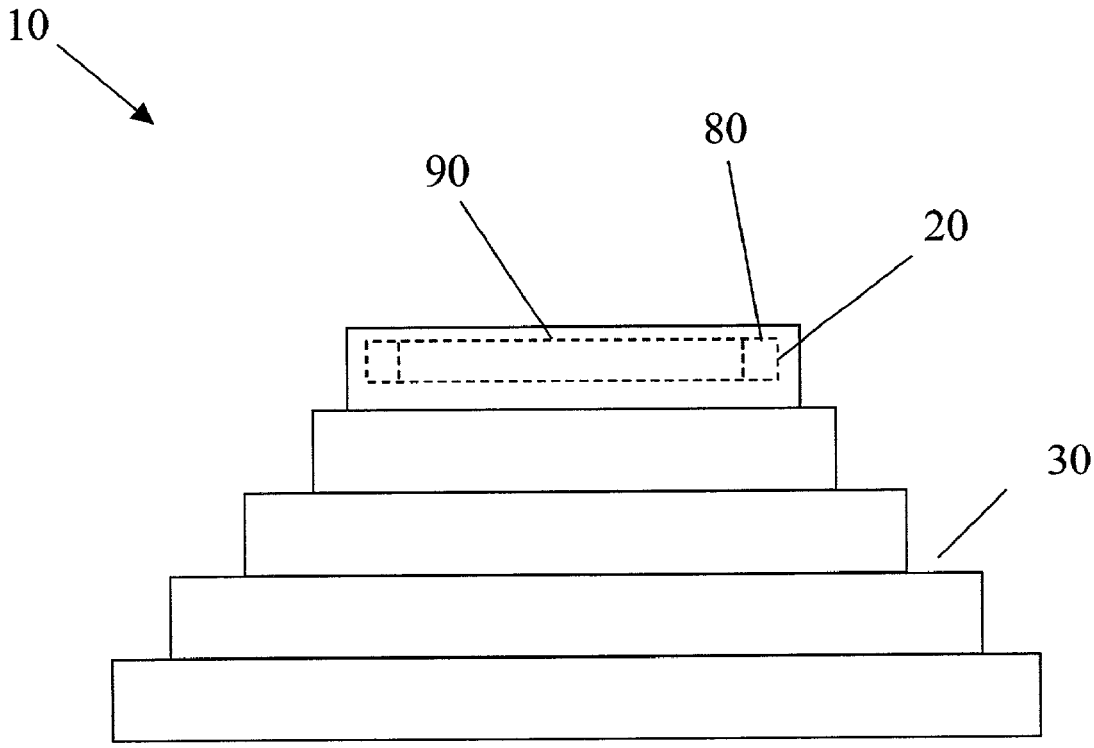
FIG. 2 is a side view of the embodiment of FIG. 1.
Figure 4:
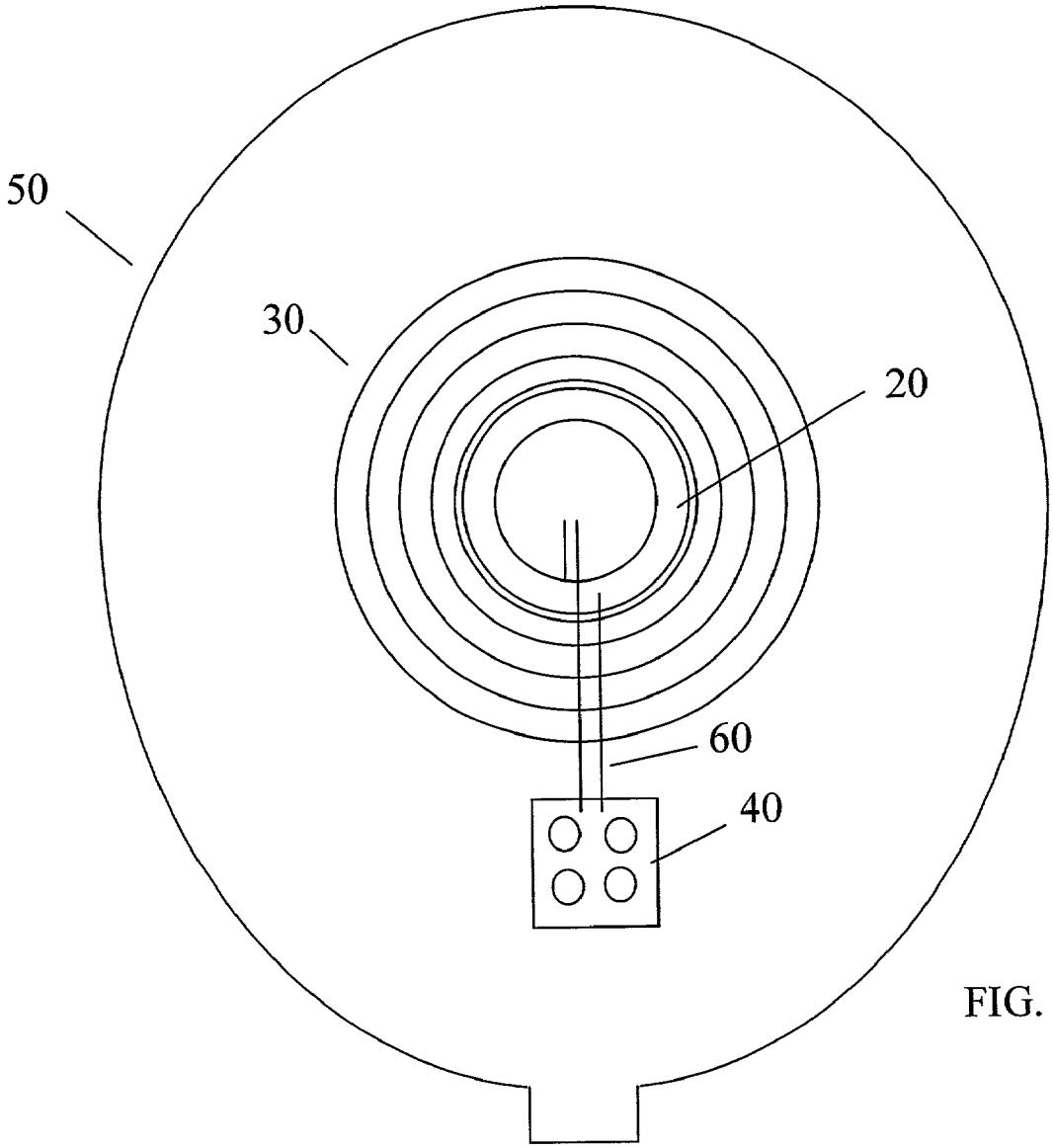
FIG. 4 is a front view of a sound module in accordance with present invention attached to a balloon sheet.

In a preferred embodiment of the sound module 10 illustrated in FIGS. 1, 2 and 4, each of the rings has a ½" width, although varying the width of each ring or of some rings can be employed to emphasize different frequencies. The height of the sound module 10 from the surface of the balloon to the top of the piezo amplification device is 3/16 of an inch. These figures are exemplary only and are in no way intended to be limiting on the scope of the invention since other dimensions may be employed. In addition to these dimensions, the corners of the steps are rounded and the height of the piezo amplification device 30 is minimized so that the sound module 10 may be run through rollers that are used to in the process of forming the balloon 50. Again those skilled in the art will recognize that the corners need not be rounded and the height need not be minimized if the sound module 10 is to be connected to another device other than a balloon 10.

As illustrated in FIGS. 1 and 2, the piezo amplification device 30 includes a set of concentric rings arranged in a step pattern with the smaller diameter rings being stacked on the larger diameter rings to form a pyramid like shape. In a preferred embodiment the pyramid shape is formed as an integral unit made up of the different circular rings and the corners of the rings are rounded. However those skilled in the art will recognize that the piezo amplification device 30 could be formed by attaching separate rings together.

As illustrated in FIG. 2, a preferred embodiment of the invention includes 5 steps or rings with the piezoelectric element 20 secured in the top step. However those skilled in the art will recognize that as few as 1 ring/step or more than 5 rings/steps could be employed without departing from the scope of the invention.

In operation, the sound module 10 is attached to the balloon 50. Since the sound module 10 may be placed within the rollers that are used to form the balloon 50, the sound module 10 may be secured to the interior or exterior of the balloon 50. The sound module 10 is attached by securing the bottom portion of the piezo amplification device 30 to the balloon 50 with glue or in some other manner. When the piezo amplification device is secured to the balloon 50 a cavity is formed between the piezo amplification device 30 and the balloon 50. The electric circuit 40 generates audio signals that are transmitted through the wires 60 to the piezoelectric element 20. The piezoelectric element 20 responds to the audio signals by converting the signals into sounds and enunciating the same, thereby serving as a speaker. The sounds resonate off the walls of the balloon 10, generating amplified sounds corresponding to the programmed or prerecorded sound (e.g. voice and/or music and/or some other sound).

While a preferred embodiment has been described, many alternatives are possible each of which falls within the scope of the present invention. One such alternate embodiment is shown in FIG. 3.

Figure 3:
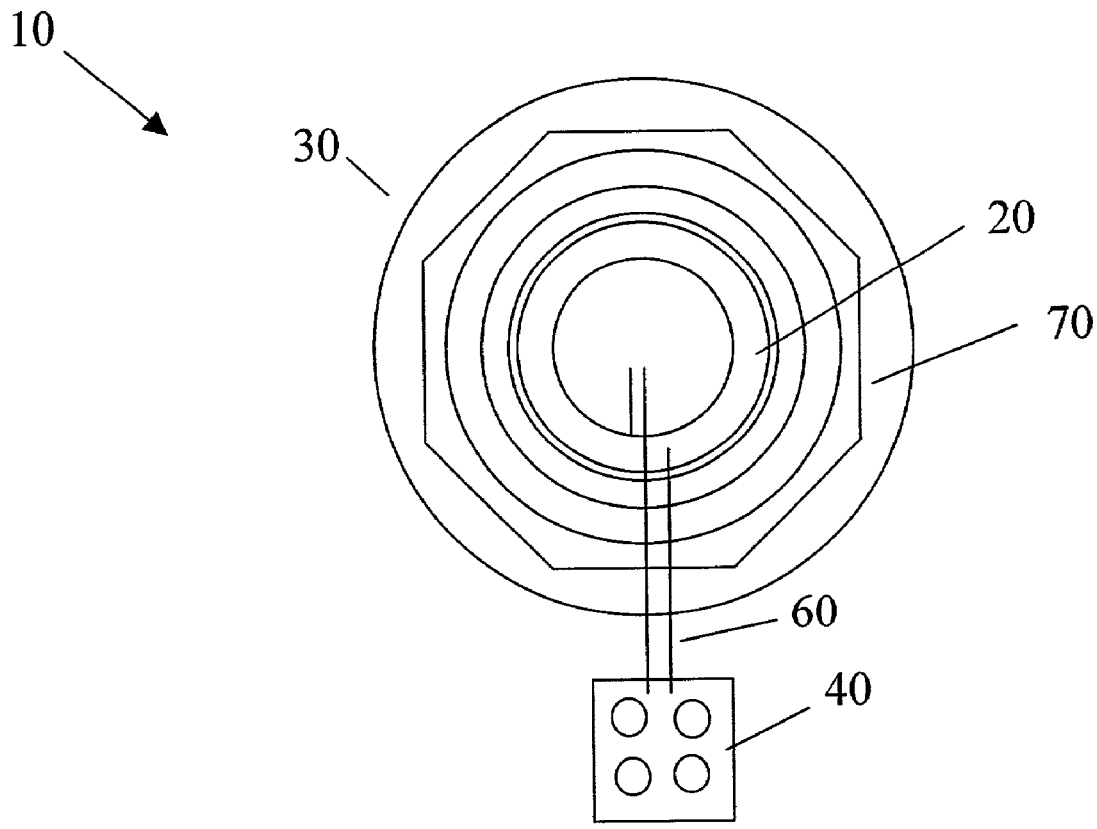
FIG. 3 is a front view of an alternate embodiment of the invention.

The embodiment of FIG. 3 illustrates that the rings 70 that form the piezo amplification device 30 could be shapes other than circular rings. They could be square, rectangular, hexagonal, octagonal etc. Additionally, not all of the rings 70 have to be the same shape. As illustrated in FIG. 3, one or more of the rings 70 could be the same while one or more of the rings 70 could be different shapes. Those skilled in the art will recognize that the design of the piezo amplification device could range anywhere from all rings having the same general shape to no two rings having the same general shape.

Figure 7:
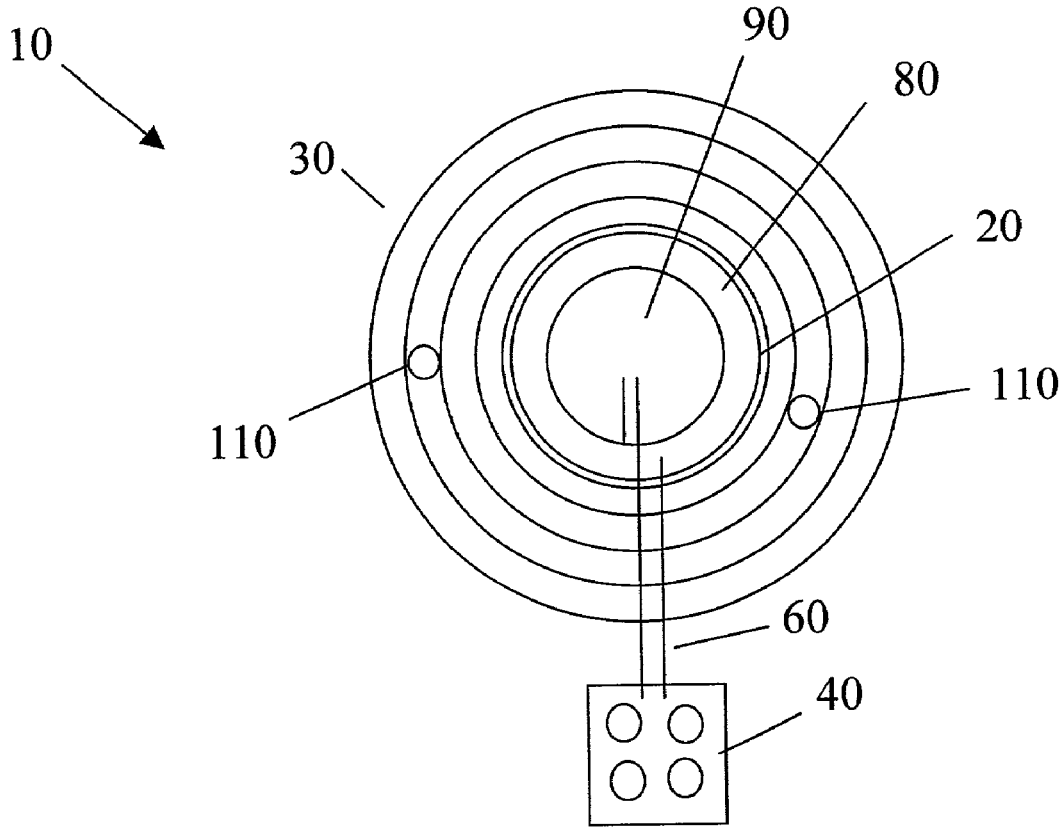
FIG. 7 is a front view of an alternate embodiment of the invention.

Additionally, one or more of the rings could have holes 110 therein (as illustrated in FIG. 7).

Figure 5:
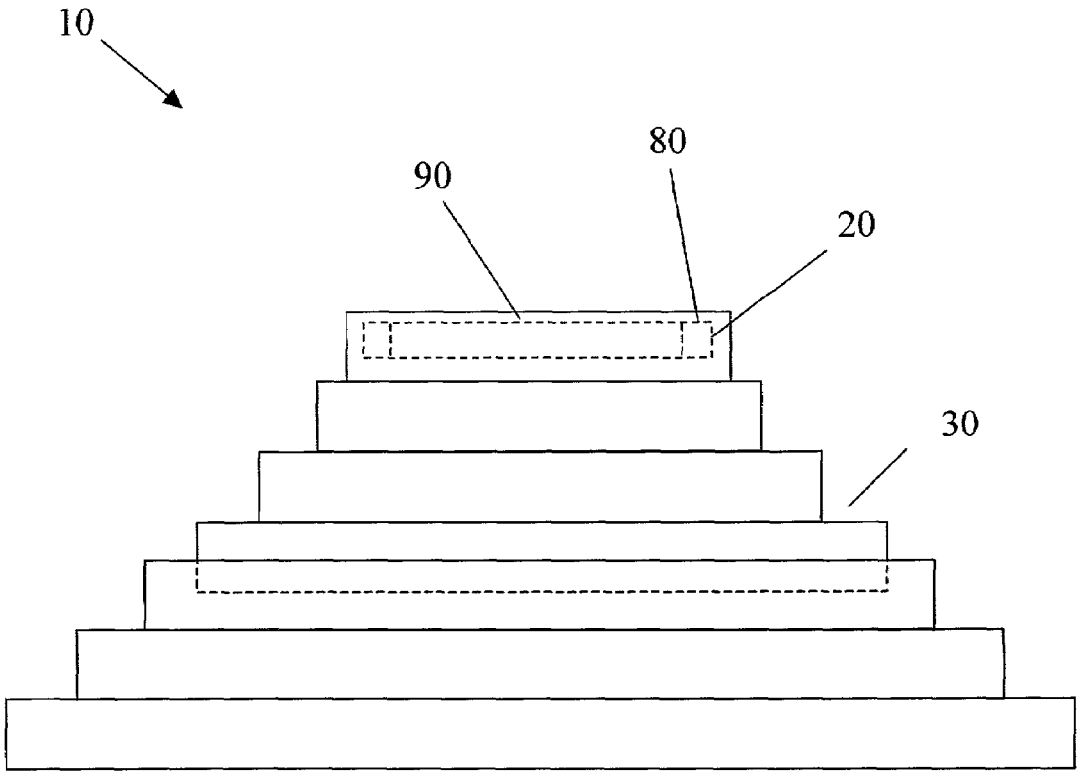
FIG. 5 is a side view of an alternate embodiment of the invention.

Another alternate embodiment is illustrated in FIG. 5. In FIG. 5, the steps of the piezo amplification device 30 begin to rise into the pyramid as in the embodiment disclosed in FIGS. 1–4, but then prior to reaching the apex of the pyramid shape the steps descend before rising again. While FIG. 5 only illustrates a single drop by a single step, multiple steps could drop down before rising again and/or there could be multiple up and down shifts.

Figure 6:
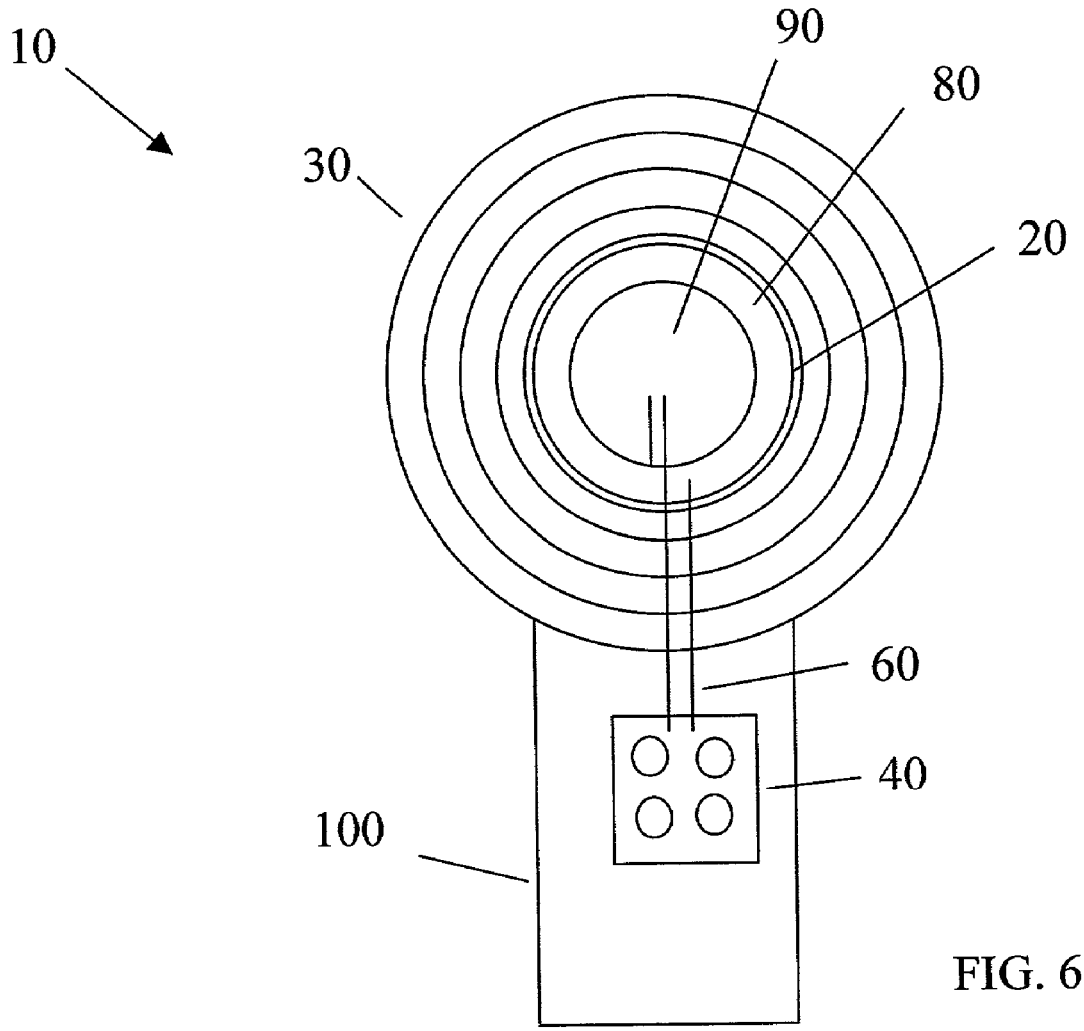
FIG. 6 is a front view of an alternate embodiment of the invention.

In another embodiment of the invention depicted in FIG. 6, the piezo amplification device 30 includes a tail portion 100. The tail portion 100 extends radially from the outermost ring and is used to support the electric circuit 40.

It will be understood that changes may be made in the above construction and in the foregoing sequences of operation without departing from the scope of the invention. For example, the sound module 10 need not be connected to a balloon, but instead it could be attached to any inflatable object, to a card, to a box, etc. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A sound module, the sound module comprising:

a piezo amplification device;

a piezoelectric element coupled to the piezo amplification device; and an inflatable object attached to said piezo amplification device so as to form a cavity between an interior of the piezo amplification device and the inflatable object, the inflatable object having an interior bounded by walls;

an electrical circuit electrically coupled to the piezoelectric element and configured to generate audio signals, the piezoelectric element being configured to convert the audio signals into sound that resonates off the walls within the interior of the inflatable object.

2. The sound module according to claim 1 wherein the piezo amplification device comprises semi-rigid foam.

3. The sound module according to claim 1 wherein the piezo amplification device has at least one hole therein in which is arranged the piezo electric element.

4. The sound module according to claim 1, wherein the inflatable object is a balloon.

5. A sound module attachable to an object, the sound module comprising:

a piezo amplification device;

a piezoelectric element coupled to the piezo amplification device an inflatable object;

said piezo amplification device being attachable to the inflatable object to form a cavity between the piezo amplification device and the inflatable object;

the piezo amplification device including a plurality of concentrically stacked rings.

6. The sound module according to claim 5 wherein the rings are stacked with the largest ring forming a bottom of the piezo amplification device and the smallest ring forming a top.

7. The sound module according to claim 5 wherein the stack of rings comprises an integral unit.

8. The sound module according to claim 5 further comprising:

a tail portion extending radially out from one of the rings;

the electrical circuit being coupled to the tail portion.

9. The sound module according to claim 5 wherein at least two of the rings are different shapes from each other.

10. A sound module comprising:

a speaker;

an amplification device arranged to space the speaker from an inflatable object so as to form a cavity between an interior of the amplification device and the inflatable object, the amplification device being attached to the inflatable object, the inflatable object having an interior bounded by walls; and, a circuit configured to generate audio signals and being electrically coupled to the speaker, the speaker being configured and arranged to convert the audio signals into sound that resonates off the walls within the interior of the inflatable object.

11. The sound module according to claim 10, wherein the amplification device has a hole in which is arranged the speaker.

12. The sound module according to claim 10, wherein the inflatable object is a balloon.

13. A sound module attachable to an inflatable object, the sound module comprising:

a semi-rigid pyramid shaped piezo amplification device having a top, a bottom and an interior, the pyramid shape being formed by concentrically stacking rings such that a ring stacked closer to the top of the piezo amplification device is smaller than a ring stacked closer to the bottom of the piezo amplification device;

the piezo amplification device being attachable to the inflatable object at a bottom most ring of the piezo amplification device;

wherein when the piezo amplification device is attached to the inflatable object, the interior of the piezo amplification device and the inflatable object form a cavity;

a piezoelectric element coupled to one of the rings at the top of the piezo amplification device;

an electrical circuit electrically coupled to the piezoelectric element; the electrical circuit being configured to generate audio signals; and, the piezoelectric element being configured to convert the audio signals into sound that resonates within the inflatable object.

14. The sound module according to claim 13 wherein:

the semi-rigid piezo amplification device comprises an integral unit.

15. The sound module according to claim 13 further comprising:

a tail portion extending radially out from the piezo amplification device;

wherein the electrical circuit is coupled to the tail portion.

16. The sound module according to claim 13 wherein at least two of the rings are different shapes from each other.

17. The sound module according to claim 13 wherein the semi-rigid piezo amplification device comprises foam.

18. The sound module according to claim 13 wherein the semi-rigid piezo amplification device has at least one hole therein.

19. The sound module according to claim 13 wherein the inflatable object comprises a balloon.

* * * * *